US009362073B2

(12) United States Patent
Min et al.

(10) Patent No.: US 9,362,073 B2
(45) Date of Patent: Jun. 7, 2016

(54) SWITCH APPARATUS FOR VEHICLE

(71) Applicants: Hyundai Motor Company, Seoul (KR); Kia Motors Corp., Seoul (KR); DONG HEE INDUSTRIAL CO., LTD., Ulsan (KR)

(72) Inventors: Jeong Seon Min, Gwangju (KR); Yang Rae Cho, Suwon-si (KR); Hyung Suk Kim, Hwaseong-si (KR); Young Je Park, Suwon-si (KR); Dong Hwan Kim, Ulsan (KR)

(73) Assignees: Hyundai Motor Company, Seoul (KR); Kia Motors Corp., Seoul (KR); DONG HEE INDUSTRIAL CO., LTD., Ulsan (KR)

( * ) Notice: Subject to any disclaimer, the term of this patent is extended or adjusted under 35 U.S.C. 154(b) by 401 days.

(21) Appl. No.: 13/933,994

(22) Filed: Jul. 2, 2013

(65) Prior Publication Data

US 2014/0326587 A1 Nov. 6, 2014

(30) Foreign Application Priority Data

May 6, 2013 (KR) ..... 10-2013-0050735

(51) Int. Cl.

| | |
|---|---|
| ***H01H 3/14*** | (2006.01) |
| ***H01H 50/14*** | (2006.01) |
| ***H01H 50/04*** | (2006.01) |

(52) U.S. Cl.

CPC ..... *H01H 50/14* (2013.01); *H01H 50/047* (2013.01)

(58) Field of Classification Search

CPC ..... H01H 13/16; H01H 3/14; H01H 1/00; H01H 1/06; H01H 1/12; H01H 3/00; H01H 3/02; H01H 3/08; H01H 3/161; H01H 3/30; H01H 3/32; H01H 3/42; H01H 3/50; H01H 3/81; H01H 3/86; H01H 19/00; H01H 19/04; H01H 19/14; H01H 19/16; H01H 2003/00; H01H 2003/02; H01H 2003/08; H01H 2231/026; H01H 2231/038; B60Q 1/44; B60T 7/02

USPC ..... 439/188, 95, 181, 939, 947

See application file for complete search history.

(56) References Cited

FOREIGN PATENT DOCUMENTS

| | | | |
|---|---|---|---|
| KR | 10-0818848 | B1 | 4/2008 |
| KR | 10-2009-0044198 | A | 5/2009 |
| KR | 10-2009-0054359 | A | 5/2009 |
| KR | 10-2009-0095047 | A | 9/2009 |
| KR | 10-2010-0136147 | A | 12/2010 |
| KR | 10-2014-0086153 | A | 7/2014 |

*Primary Examiner* — Renee Luebke

*Assistant Examiner* — Anthony R. Jimenez

(74) *Attorney, Agent, or Firm* — Morgan, Lewis & Bockius LLP

(57) ABSTRACT

A switch apparatus may include a switch body to which a connector of an electronic unit is connected and in which a relay board is provided, a conductive coupling section provided at a lower end of the switch body to be coupled to a vehicle body, and a conductive ground member having a base provided at a lower portion in an internal space of the switch body to be coupled to an upper end of the coupling section, and a clamping bar extending upwards from one side of the base to be coupled to a ground terminal provided at a lower end of the relay board.

18 Claims, 13 Drawing Sheets

SWITCH APPARATUS FOR VEHICLE

CROSS REFERENCE TO RELATED APPLICATION

The present application claims priority of Korean Patent Application Number 10-2013-0050735 filed May 6, 2013, the entire contents of which application are incorporated herein for all purposes by this reference.

BACKGROUND OF INVENTION

1. Field of Invention

The present invention relates, in general, to a switch apparatus for a vehicle, which is mounted at a place where ON/OFF control is required in a vehicle and, more particularly, to a switch apparatus for a vehicle to which a relay is coupled to maintain a current applied to a switch constant.

2. Description of Related Art

Generally, a switch apparatus for a vehicle performs a series of operative actions when a user intentionally manipulates an operating tool to drive a vehicle so that a predetermined level of manipulation is detected.

For example, in the case of a stop lamp switch mounted to a brake system, when a user steps on a brake pedal to stop a vehicle, the stop lamp switch of a stop lamp mounted to the brake pedal of the vehicle is activated to turn on the stop lamp. However, a conventional switch apparatus has drawbacks in that, if an overcurrent flows through a switch thereof, a contact of the switch is often carburized.

In order to prevent the overcurrent from being applied to the switch, a relay is mounted to a junction box, which, however, results in the complicated replacement of parts and increased cost. Particularly, in the case of an old vehicle to which a relay is not adapted, due to the problem of overcurrent, the switch needs to be frequently replaced with a new one, which is troublesome and inconvenient work.

FIG. 14 shows a portion of parts of a conventional switching apparatus for a vehicle. However, in the conventional switch apparatus, when a defective switch is replaced with a new one, a troublesome replacement must be carried out, wherein the switch apparatus is first dissembled from a vehicle body, and a wire assembly, which includes connecting wires 11, 20, 13, and 40 connected to a connector side, a fixing bracket side, a relay side, and a ground side, respectively, of a vehicle, must be replaced.

To solve this problem, as disclosed in Korean Patent Laid-Open Publication No. KR 10-2009-0054359 A, a contactless stop lamp switch using a back-bias type cam shaft hall sensor is proposed, in which a relay is mounted to a switch thereof such that a distance between the switch and a brake pedal is measured using the hall sensor. However, the stop lamp switch still has problems in that the configuration is complicated and the cost increases because the hall sensor, a magnet, ICs, and the like are required, a sensitive sensor possibly causes a malfunction, and upon replacement, all of the connecting wires, including a ground wire or the like, should be troublingly replaced.

Therefore, there is a need for a switch apparatus for a vehicle which has a simple structure even though a switch and a relay are provided in an integral form, and facilitates easy replacement of any parts including a ground wire earthed to a vehicle body.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Accordingly, the present invention has been made in an effort to provide a switch apparatus that solves at least some of the above-mentioned or other problems occurring in the related art. Various aspects of the present invention are directed to provide a switch apparatus for a vehicle which has a simple structure even though a switch and a relay are provided in an integral form, and facilitates easy replacement of any parts including a ground wire earthed to a vehicle body, and easy maintenance at low cost.

According to various aspects of the present invention, a switch apparatus for a vehicle may include a switch body to which a connector of an electronic unit is connected and in which a relay board is provided, a conductive coupling section provided at a lower end of the switch body to be coupled to a vehicle body, and a conductive ground member having a base provided at a lower portion in an internal space of the switch body to be coupled to an upper end of the coupling section, and a clamping bar extending upwards from one side of the base to be coupled to a ground terminal provided at a lower end of the relay board.

A plurality of connecting wires may be provided in the internal space of the switch body to electrically connect the connector and the relay board. The relay board may have a fitting hole for fitting a coil part. The ground terminal may be connected with the clamping bar of the ground member to form a ground circuit.

A support holder may be provided on a lower side of the relay board to fixedly support the clamping bar from a lower side of the clamping bar.

A lower surface of the switch body may have a through-hole into which the coupling section is fitted, and the base may have a fixing hole larger than the coupling section, the base being fixed to the upper end of the coupling section. The base may be fitted around and coupled with an engaging step formed on an outer side of the upper end of the coupling section.

The coupling section may have a sliding hole formed at an inner side thereof in which an operating rod is provided to vertically slide with an elastic force produced by an elastic body, such that an upper portion thereof is disposed inside the switch body.

The operating rod may include a rod-type member having a central flange part on a circumference thereof and extending in a vertical direction, and an elastic body surrounding an outer side of the rod-type member.

The sliding hole of the coupling section may have a coupling part with a decreasing end with which the flange part of the operating rod engages to prevent the operating rod from straying downwards therefrom.

The coupling section may have an upper protrusion extending towards the internal space of the switch body and having a bushing through which the operating rod passes. The elastic body may be supported by the bushing and the flange at upper and lower portions thereof, respectively, to maintain its position.

The operation rod may have a hook part on the upper end thereof disposed in the switch body, and a disc-type coupler fixedly fitted around the hook part so that the switch apparatus is activated as the coupler changes its position with a motion of the operating rod.

An inner coupler part may be provided between the hook part and the coupler to pass through and engage with the hook part, and have an outer engaging step portion around which the coupler is fitted.

The operating rod may have a lower extension passing through the coupling section and coming into contact with a pedal in a vehicle. The relay board may have a fixing groove into which the clamping bar of the ground member is fixed to support the relay board.

The coupling section may pass through and engage with a bracket hole formed at a central portion of a fixing bracket provided in a vehicle, and a locking bracket part may be inserted into the bracket hole to connect the fixing bracket and the coupling section.

According to the present invention, since a ground circuit extending through the inside of the switch apparatus from the ground terminal is formed, the switch apparatus provides a relay function without requiring a separate relay to be mounted to a junction box, while utilizing a reliability-verified existing switch as it is without a considerable change in design, thereby removing a requirement for additional parts and thus saving on the manufacturing cost.

Further, since a ground circuit extending through the inside of the switch apparatus from the ground terminal is formed to have a ground function and a relay function, the switch apparatus does not require a wire assembly during mounting or replacement thereof, thereby improving assembly efficiency.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
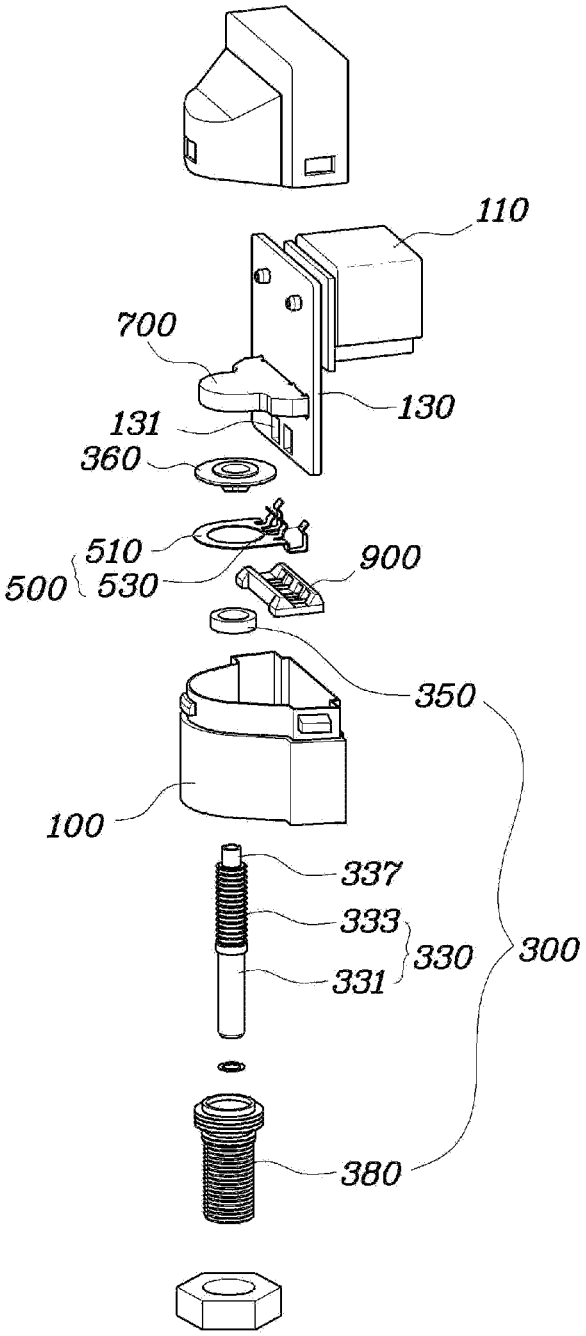
FIG. 1 is an exploded perspective view of an exemplary switch apparatus for a vehicle according to the present invention.
Figure 2:
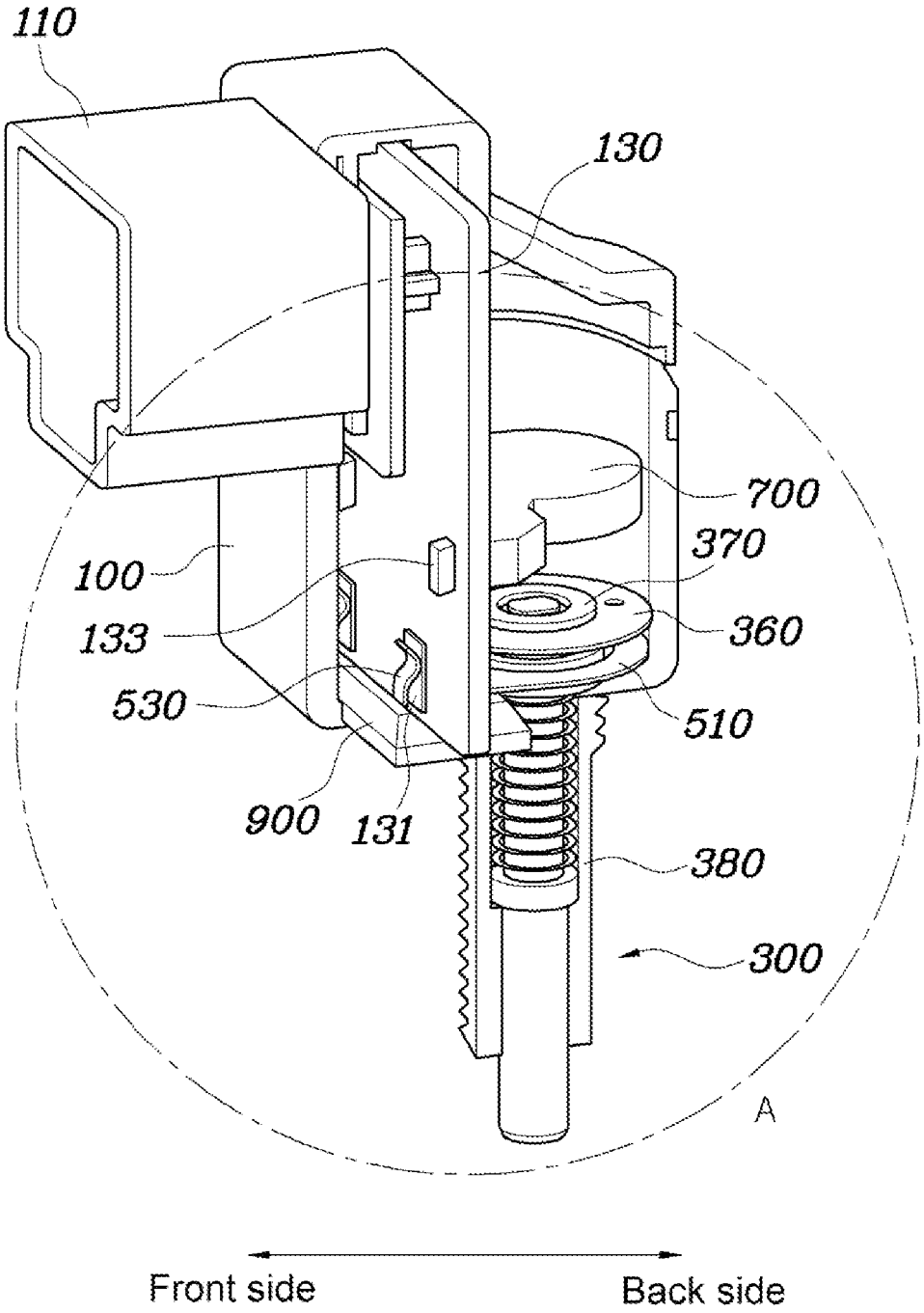
FIG. 2 is a view of an exemplary switch apparatus for a vehicle according to the present invention.
Figure 3:
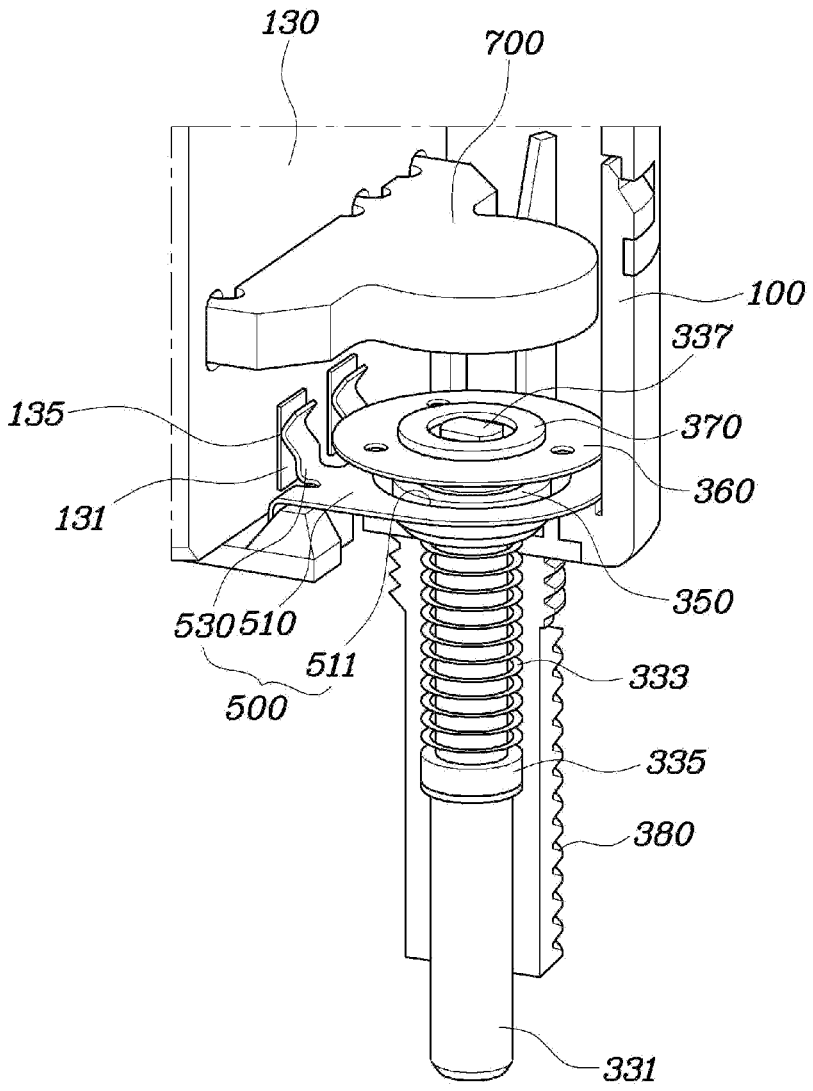
FIG. 3 is an enlarged view of section A shown in FIG. 2.
Figure 4:
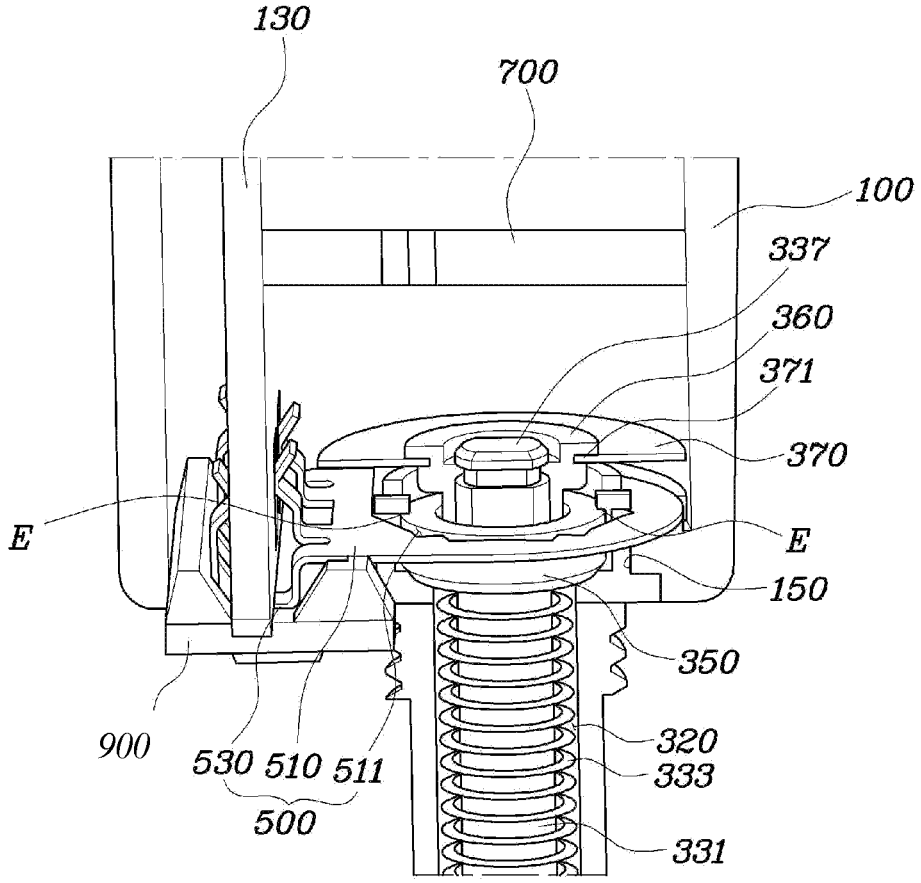
FIG. 4 is a side view of FIG. 3.

FIG. 1 is an exploded perspective view of a switch apparatus for a vehicle according to various embodiments of the present invention, FIG. 2 is a view of a switch apparatus for a vehicle according to various embodiments of the present invention, FIG. 3 is an enlarged view of section A shown in FIG. 2, and FIG. 4 is a side view of FIG. 3.

The switch apparatus for a vehicle includes a switch body 100 to which a connector 110 of an electronic unit is connected and in which a relay board 130 is provided, a conductive coupling section 300 which is provided at a lower end of the switch body 100 to be coupled to a vehicle body, and a conductive ground member 500. The conductive ground member 500 has a base 510 which is provided at a lower portion in an internal space of the switch body 100 to be coupled to an upper end of the coupling section 300, and a clamping bar 530 which extends upwards from one side of the base 510 to be coupled to a ground terminal 131 provided at a lower end of the relay board 130.

A plurality of connecting wires is provided in the internal space of the switch body 100 to electrically connect the connector 110 and the relay board 130. The relay board 130 has a fitting hole 133 through which a coil part 700 is fitted. The fitting hole 133 is provided on the lower side of the relay board 130 such that the coil part passes through and fixedly engages with the fitting hole according to various embodiments of the present invention. However, in some embodiments, the coil part may not necessarily pass through the fitting hole; it may be coupled thereto by means of other methods.

The ground terminal 131 is provided at a lower end of the relay board 130 such that the ground terminal is connected with the clamping bar 530 of the ground member 500 to form a ground circuit. A support holder 900 is provided on a lower side of the relay board 130 to fixedly support the clamping bar 530 from a lower side of the clamping bar 530.

As described above, the ground member 500 has the base 510 and the clamping bar 530 which extends upwards from the front end of the base 510. The base 510 of the ground member 500 has a central fixing hole 511. The clamping bar 530 has a type of bar, and the end part of the base 510 is divided into several parts to form the clamping bars.

Although the number of clamping bars, which are formed from the several end parts of the base 510, is shown as being four in FIG. 4 by way of illustration, the number may be readily varied and be of any number. As an example, in the illustrated embodiment, two outer clamping bars of the four clamping bars are bent downwards and fitted in the holder 900 to support the front side of the relay board 130, and two remaining inner clamping bars are bent at a lower height than that of the outer clamping bar to support the back side of the relay board 130.

As shown in FIG. 4, the clamping bars 530 and the relay board 130 may come into contact with each other at different positions, and may also engage with each other. The clamping bar 530 can exert an elastic force in the direction toward which the clamping bar is bent, to elastically support the relay board 130. Further, the holder 900 more firmly supports the relay board 130 on the lower side thereof, thereby preventing the relay board 130 from shaking due to vibrations or impact applied to a vehicle during the driving of the vehicle.

The relay board 130 has a fixing groove 135, to which the clamping bar 530 is fixedly fitted, to firmly support the clamping bar 530, thereby preventing the clamping bar 530 from being detached from the relay board 130 by vibrations or the like occurring during the driving of a vehicle.

The switching body 100 has, on the lower surface thereof, a through-hole 150, through which the coupling section 300 is firmly coupled by means of press-fit, injection or the like. To the upper end of the coupling section 300, the base 510 is fixed which has the fixing hole 511 that is larger than the coupling section 300. The coupling section 300 has an engaging groove 310 on an outer circumference of the upper portion thereof, and the base 510 is fitted into the engaging groove, so the base is prevented from being detached from the coupling section by vibrations occurring during the driving of a vehicle, or by the manipulation of the operating rod 330.

As such, since the ground terminal 131 on the lower end of the relay board 130 is coupled to the clamping bar 530 of the ground member 500, the clamping bar 530 forms one side of the base 510, and a rod-type member 331 of the coupling section 300 is earthed to a vehicle body, a ground circuit is formed which extends from the connector 110 to the vehicle body through the relay board 130, the ground member 500, and the coupling section 300. Thus, since the conductive coupling section 300 comes into direct contact with the vehicle body, even though the rod-type member 331 is not formed from a conductive body, the ground circuit can be formed. This allows for a material of the rod-type member 331 to be selected according to the design of a product, thereby saving on the cost.

According to the present invention, since a ground circuit extending through the inside of the switch apparatus from the ground terminal is formed, the switch apparatus has a relay function without a separate relay being mounted to a junction box while utilizing a reliability-verified existing switch as it is without a considerable change in design, thereby removing additional parts and thus saving on the manufacturing cost.

Further, since a ground circuit extending through the inside of the switch apparatus from the ground terminal is formed to have a ground function and a relay function, the switch apparatus needs not to have a wire assembly during mounting or replacement thereof; thereby improving assembly efficiency.

Figure 5:
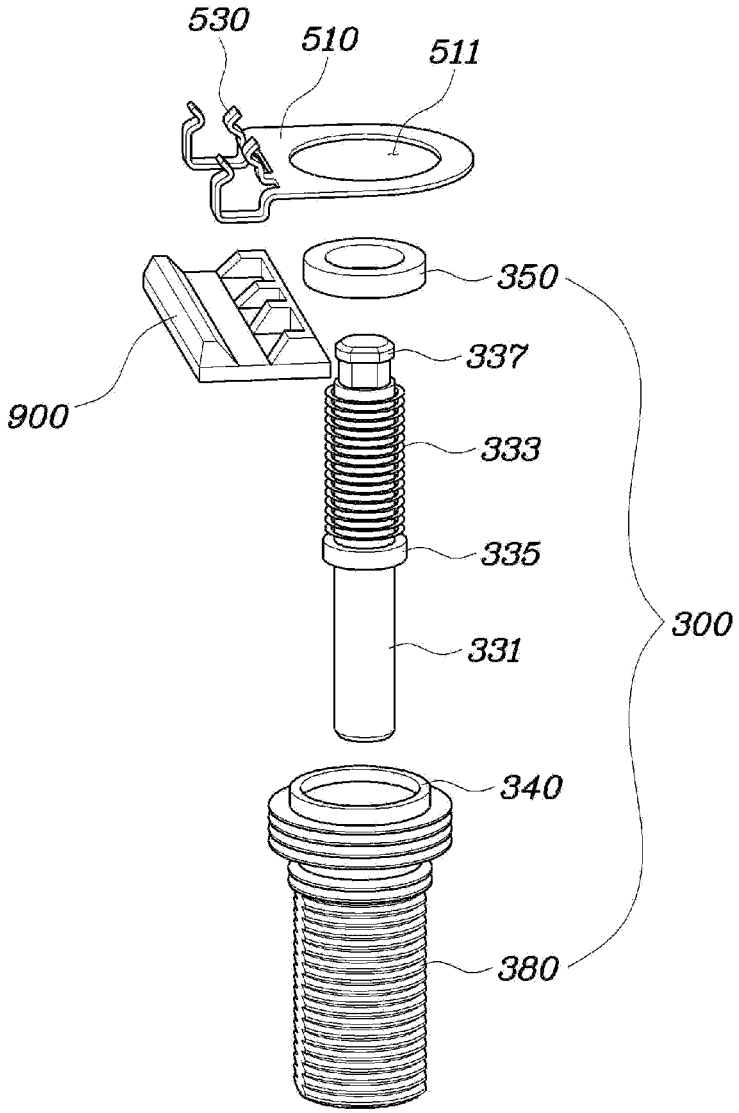
FIG. 5 is an exploded perspective view showing a coupling section, a ground member, and a holder of an exemplary switch apparatus for a vehicle according to the present invention.
Figure 6:
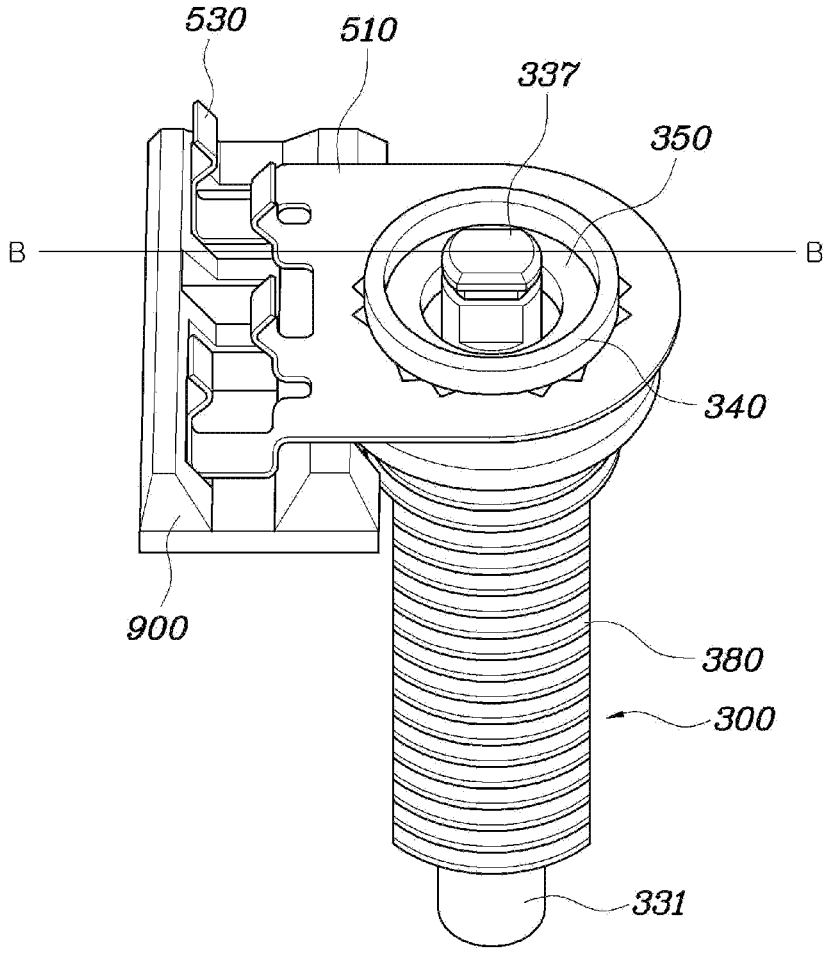
FIG. 6 is a view showing an assembly of the elements shown in FIG. 5.
Figure 7:
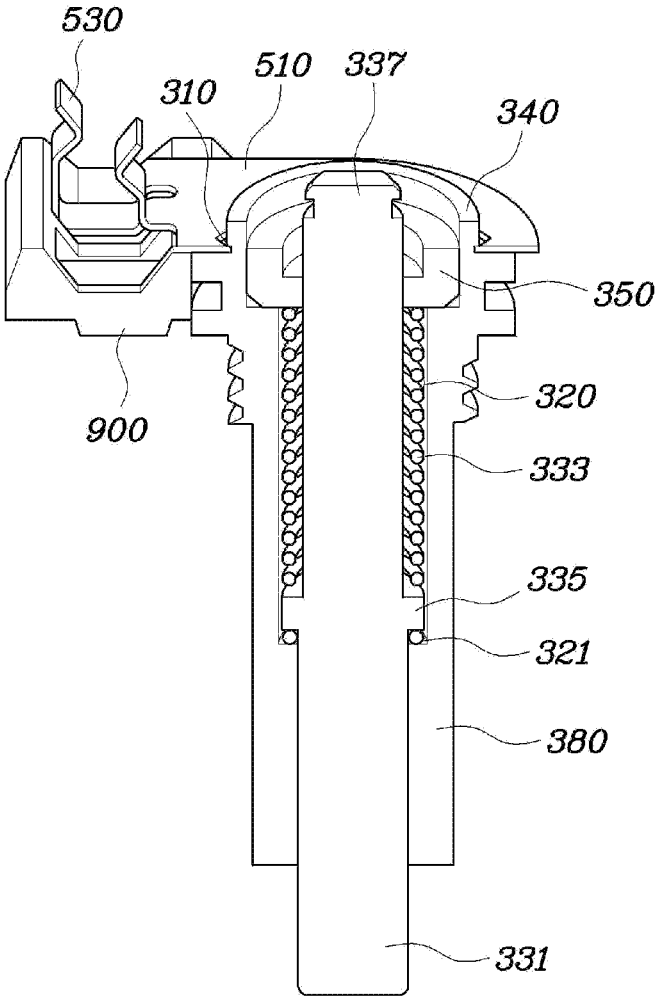
FIG. 7 is a cross-sectional view taken along line B-B of FIG. 6.
Figure 8:
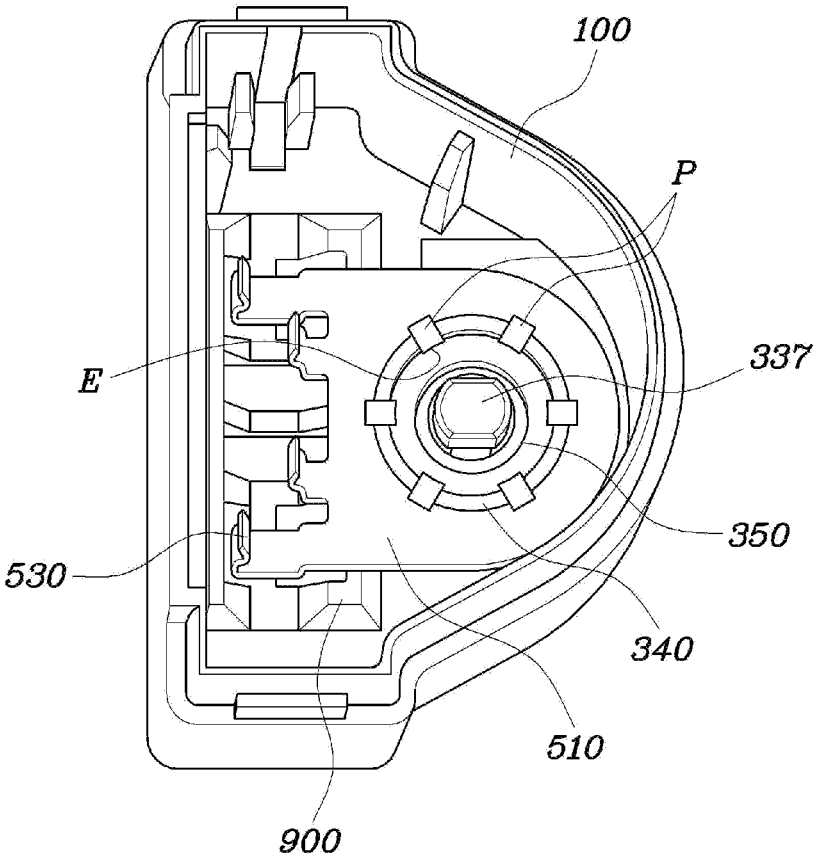
FIG. 8 is a plan view of FIG. 6.
Figure 9:
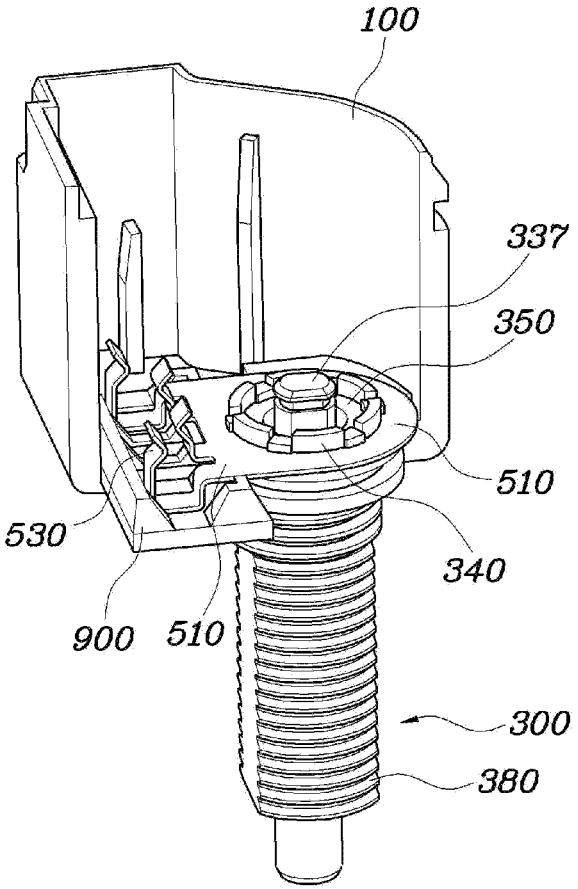
FIG. 9 is a view showing the assembly of FIG. 6 coupled with a switch body.

FIG. 5 is an exploded perspective view showing the coupling section 300, the ground member 500, and the holder 900, wherein the coupling section 300 has a bushing 350, an operating rod 330, and a threaded part 380, FIG. 6 is a view showing an assembly of the elements shown in FIG. 5, FIG. 7 is a cross-sectional view taken along line B-B of FIG. 6, FIG. 8 is a plan view of FIG. 6, and FIG. 9 is a view showing the assembly of FIG. 6 coupled with the switch body 100.

Referring to FIG. 7, the coupling section 300, in particular, the threaded part 380, has a sliding hole 320 formed at an inner side thereof in which the operating rod 330 is provided to vertically slide with an elastic force produced by an elastic body 333, such that an upper portion thereof is disposed inside the switch body 100.

The threaded part 380 is provided on its circumference with a partially-threaded portion and a planar portion that is the rest of the partially-threaded portion on the circumference. The threaded part has a cylindrical shape with a substantially semi-circle as a sectional shape.

The operating rod 330 moves vertically in the sliding hole 320, and includes a rod-type member 331 which extends in a vertical direction, and an elastic body 333 which surrounds an outer side of the rod-type member 331. The rod-type member 331 has a hook part 337 on an upper end thereof, and a central flange part 335 on a circumference thereof.

The sliding hole 320 provided in the threaded part 380 of the coupling section 300 has a coupling part 321 with a decreasing end with which the flange part 335 of the operating rod 330 engages to prevent the operating rod from straying downwards therefrom. An O-ring or the like is fitted between the flange part 335 and the coupling part 321 to prevent friction between the two parts and an inflow of foreign substance such as moisture or the like.

The coupling section 300 has an upper protrusion 340 which extends towards the internal space of the switch body 100 and which has the engaging groove 310, which is formed on the circumference thereof, such that a circumference of the fixing hole 511 of the base 510 is fitted into and engages with the engaging groove 310. While the base 510 and the coupling section 300 are coupled together by press-fit between the fixing hole 511 and the upper protrusion 340, the base 510 and the coupling section 300 may be coupled by various coupling methods.

The upper protrusion 340 is provided on the circumference thereof with a plurality of fixing elements P at, for example, substantially regular intervals. The fixing elements are provided at a certain depth from an upper end of the circumference of the upper protrusion by downward pressing. When the fixing elements P are pressed in the inward direction, the fixing elements form engaging steps E inside the coupling section 300. The engaging steps E prevent a bushing 350, which passes through the operating rod 330 in the coupling section, from being detached upwards from the coupling section.

The fixing hole 511 of the base 510 may have a substantially circular shape. In this case, since the base 510 and the coupling section 300 may be easily detached from each other even with small vibration or impact, the engaging groove 310 is formed on the circumference of the upper protrusion, and the fixing hole 511 has an enlarged part between the fixing elements P, thereby ensuring easy assembly/disassembly and preventing detachment after assembly.

Configuration, including size, shape, position, and the number, of the fixing elements P may readily vary according to design or application. Although the fixing strength increases as the number increases, in various embodiments of the present invention, a limited number of fixing members, for example, six fixing members, are optimally provided, taking account of their mounting positions and design of the switch apparatus.

The bushing 350 is coupled inside the coupling section 300 such that the bushing passes through the operating rod 330. The bushing 350 is formed from an elastic rubber or the like, and is coupled in the upper protrusion 340 of the threaded part 380 of the coupling section 300 to prevent friction between the operating rod 330 and the coupling section 300.

The bushing 350 is provided on the upper side of the elastic body 333 to support the upper side of the elastic body 333.

Thus, when the switch apparatus is actuated such that the rod-type member 331 of the operating rod 330 is forcedly moved upwards, the bushing serves to prevent the elastic body 333 from leaving upwards from the coupling section 300.

Thus, the elastic body 333 is supported by the bushing 350 and the flange part 335 at upper and lower portions thereof, respectively, in the sliding hole 320 of the threaded part 380, so the elastic body can maintain its position even when the switch apparatus is actuated such that the elastic body contracts and stretches.

Referring to FIG. 4, the operation rod 330 of the coupling section 300 is disposed in the switch body 100 and has a hook part 337, which passes through the fixing hole 511 of the base 510, on the upper end thereof, and a disc-type coupler 360 which has a through-hole, through which the hook part 337 is fixedly fitted.

The coupler 360 is disposed at a certain distance from the coil part 700, so that when a distance between the coupler 360 and the coil part 700 changes with a motion of the operating rod 330 to generate an eddy current, the switch apparatus can be activated.

An inner coupler part 370 is provided between the hook part 337 and the coupler 360 in such a manner as to pass through and engage with the hook part 337, and have an outer engaging step portion 371 around which the coupler 360 is fixedly fitted.

The coupler 360 is made of a conductive material, and the operating rod 330 is made of a conductive or non-conductive material. The coupler 360 and the operating rod 330 can be mounted in the switch apparatus in an assembled state. However, if the operating rod 330 is made of a non-conductive material according to design conditions or the like, when the coupler 360 is directly assembled with the hook part 337 of the operating rod 330, a mounting error or distortion may occur. In this case, when one tries to activate the switch apparatus, the coupler 360 and the coil part 700 may not be interworked and thus malfunction. Thus, the non-conductive inner coupler part 370 is fitted to the operating rod 330, and then the conductive coupler 360 is mounted around the inner coupler part 370, thereby ensuring precise, stable operation.

As such, as described before, the coupler 360 can be mounted to the switch apparatus in a state in which the coupler is assembled with the operating rod 330 directly or with the inner coupler part 370 interposed therebetween, according to various designs. In various embodiments of the present invention, the coupler is assembled with the operating rod with the inner coupler part interposed.

The switch apparatus for a vehicle of the present invention can be used in all of switch apparatuses in a vehicle in which relays are assembled. By way of illustration, an embodiment exemplifying a stop lamp switch apparatus for a brake pedal is shown in FIGS. 10 to 13.

Figure 10:
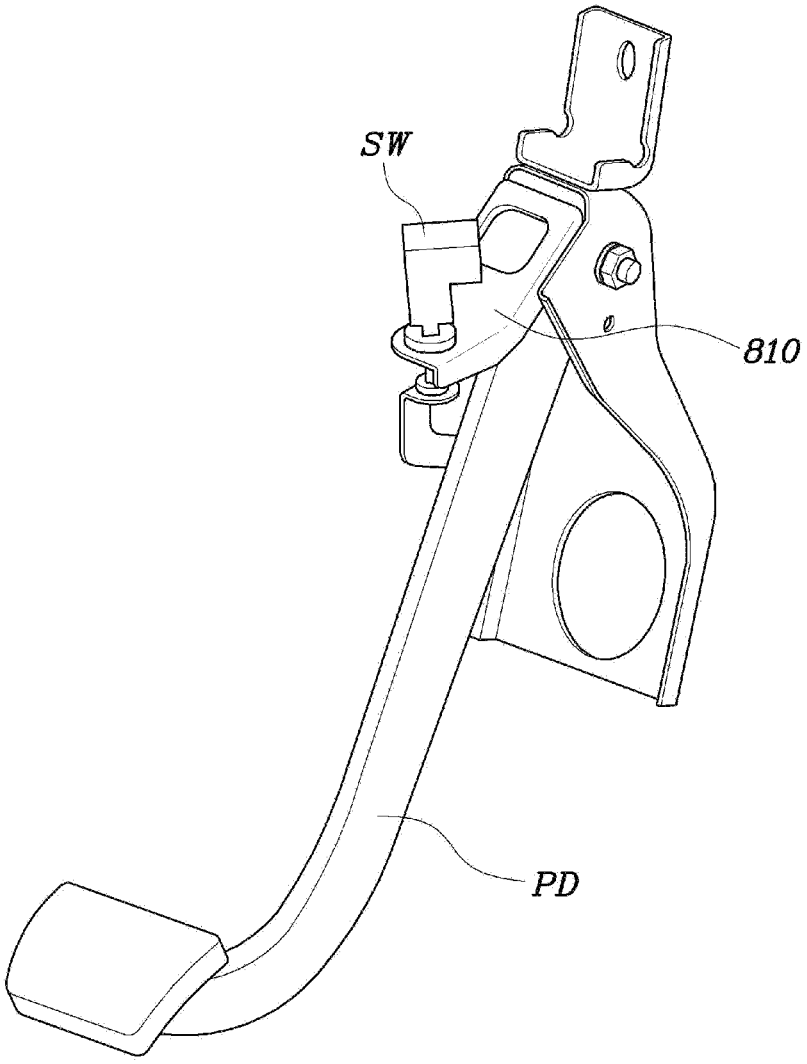
FIG. 10 is a view showing an exemplary switch apparatus being mounted.
Figure 11:
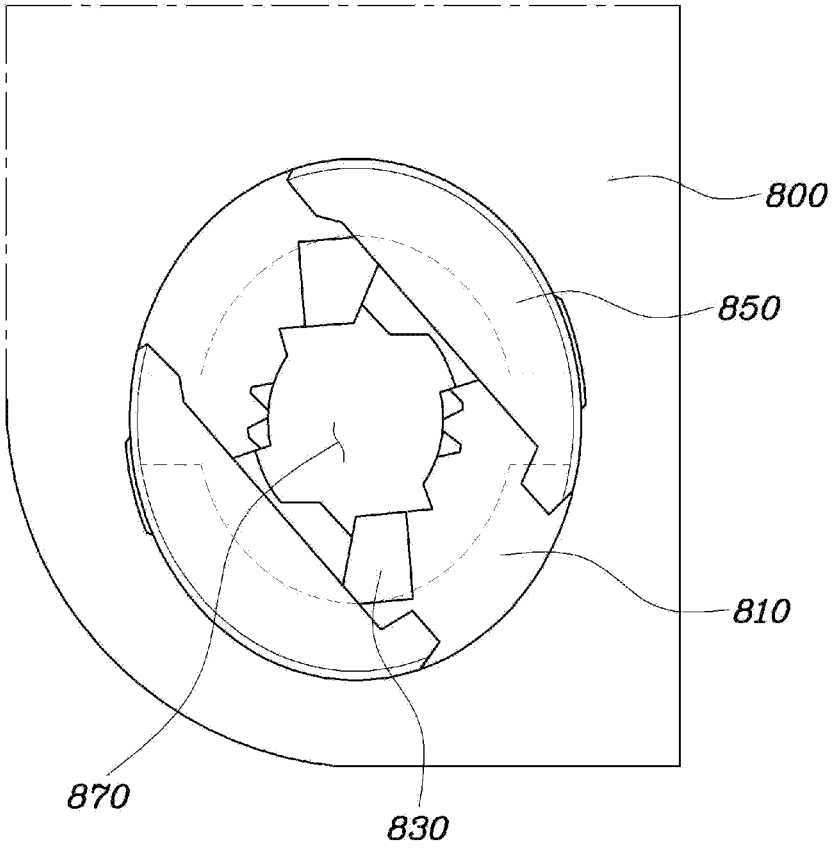
FIG. 11 is a view of a fixing bracket to which the switch apparatus will be coupled.
Figure 12:
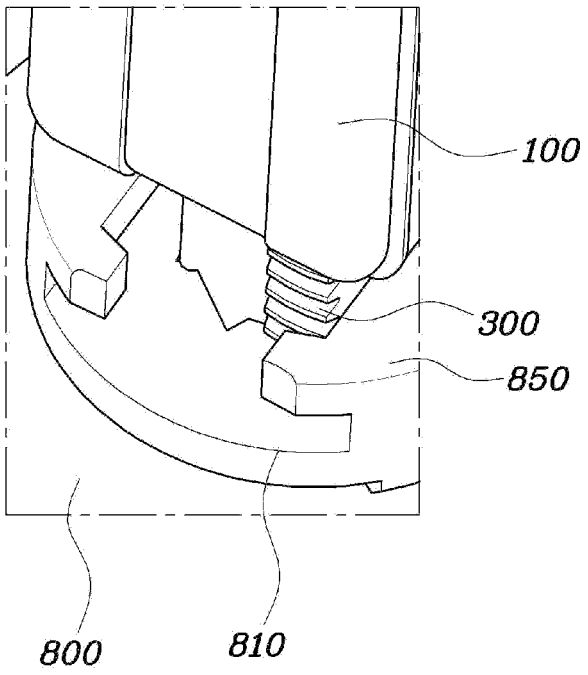
Fig. 12 (Related Art)
FIG. 12 is an enlarged view showing the state where the switch apparatus is mounted to the fixing bracket according to a conventional manner.
Figure 13:
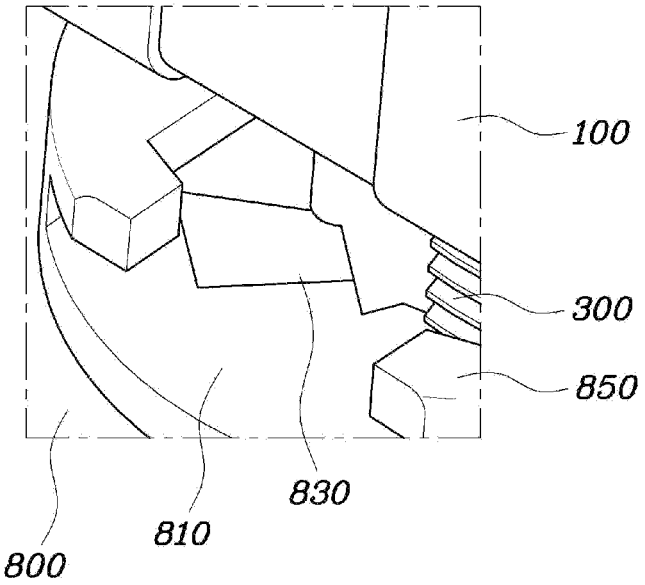
FIG. 13 is an enlarged view showing the state where the switch apparatus is mounted to the fixing bracket according to the present invention.
Figure 14:
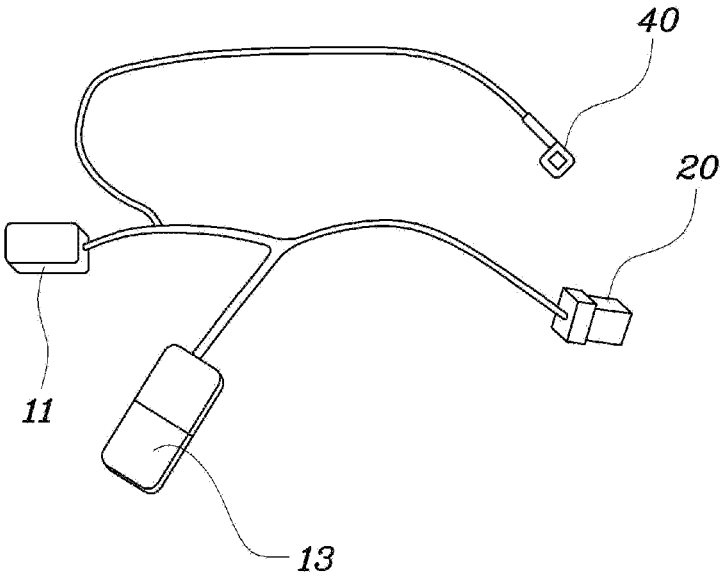
Fig. 14 (Related Art)
FIG. 14 is a view showing a portion of parts of a conventional switch apparatus for a vehicle.

FIG. 10 is a view showing the switching apparatus being mounted, FIG. 11 is a view of a fixing bracket 800 to which the switch apparatus will be coupled, FIG. 12 is an enlarged view showing the state where the switch apparatus is mounted to the fixing bracket 800 according to a conventional manner, and FIG. 13 is an enlarged view showing the state where the switch apparatus is mounted to the fixing bracket 800 according to various embodiments of the present invention.

The switch apparatus SW for a vehicle is coupled to a bracket hole 810 of the fixing bracket 800 welded with the brake pedal (PD). However, as shown in FIG. 12, according to the related art, since the switch apparatus SW is coupled in an inner hole which is formed when first and second locking cases 810 and 850, which are non-conductive members, are coupled between the fixing bracket 800 and the bracket hole 810, the switch apparatus is not earthed to a vehicle body.

Thus, as shown in FIG. 11, a conductive locking bracket 830 is formed in the non-conductive first and second locking cases 810 and 850 about the bracket hole 810 in a double-injection method. The locking bracket 830 is double-injected as shown with dotted line in FIG. 11 such that the locking bracket comes into contact with the threaded part 380 of the coupling section 300 and the fixing bracket 800, thereby forming an electric circuit extending from the switch apparatus SW to the vehicle body. The shape of the locking bracket 830 shown with the dotted line in FIG. 11 may change according to design conditions.

The fixing bracket 800 is coupled to the brake pedal (PD) via a tension spring, and the operating rod 330 passes through the threaded part 380 of the coupling section 300 so that a lower end thereof comes into contact with a contact plate attached to the fixing bracket 800.

When a driver steps on the brake pedal, the pedal pivots together with the fixing bracket 800 welded thereto. Then, the contact plate of the fixing bracket 800 is also moved far from the initial position, so that the operating rod 330, which has come into contact with the contact plate, gradually moves out of the switch apparatus SW.

As the operating rod 330 moves out, a distance between the coil part 700 and the coupler 360 connected to the upper portion of the operating rod 330 increases. This causes a change in intensity of electromagnetic waves due to interaction between en eddy current generated on the metal surface and existing electromagnetic waves. Then, if the intensity of the electromagnetic waves is above a predetermined level, it is determined that the brake pedal has been operated, and the switch apparatus is actuated to turn on a stop lamp.

As described above, in the switch apparatus SW for a vehicle, a mechanical contact is removed, and a relay board 130 which configures an electronic circuit in the switch apparatus, and a sensor unit which detects the operation of the operating rod 330 when the pedal is manipulated are provided, thereby providing more precise control related to the manipulation of the pedal, compared to the related art.

Further, since an electric ground wire is connected to the fixing bracket 800 through the ground terminal, a distance between a power source and a ground is short, and thus oxidation occurring due to the penetration of moisture can be advantageously prevented.

Of course, the description with respect to FIGS. 11 to 13 is related to the case where a locking case is used when the switch apparatus SW is fixed to the fixing bracket 800. Thus, if the switch apparatus SW is fixed to the fixing bracket 800 using a nut or the like according to design conditions, the locking bracket 830 cannot be separately used.

According to the present invention, since a ground circuit extending through the inside of the switch apparatus from the ground terminal is formed, the switch apparatus has a relay function without a separate relay being mounted to a junction box while utilizing a reliability-verified existing switch as it is without a considerable change in design, thereby removing a requirement for additional parts and thus saving on the manufacturing cost.

For convenience in explanation and accurate definition in the appended claims, the terms "upper" or "lower", "front" or "back", "outer" or "inner", "upwards" or "downwards", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A switch apparatus for a vehicle comprising:

a switch body connected to a connector of an electronic unit and including a relay board;

a conductive coupling section provided at a lower end of the switch body for coupling to a vehicle body; and a conductive ground member having a base provided at a lower portion of the switch body in an internal space of the switch body for coupling to an upper end of the coupling section, and a clamping bar extending upwards from one side of the base to be coupled to a ground terminal provided at a lower end of the relay board, wherein a support holder is provided on a lower side of the relay board to fixedly support the clamping bar from a lower side of the clamping bar.

2. The switch apparatus for a vehicle according to claim 1, wherein a plurality of connecting wires are provided in the internal space of the switch body to electrically connect the connector and the relay board.

3. The switch apparatus for a vehicle according to claim 1, wherein the relay board has a fitting hole for fitting a coil part.

4. The switch apparatus for a vehicle according to claim 1, wherein the ground terminal is connected with the clamping bar of the ground member to form a ground circuit.

5. The switch apparatus for a vehicle according to claim 1, wherein a lower surface of the switch body has a through-hole into which the coupling section is fitted, and the base has a larger fixing hole than the coupling section, the base being fixed to the upper end of the coupling section.

6. The switch apparatus for a vehicle according to claim 5, wherein the base is fitted around and coupled with an engaging step formed on an outer side of the upper end of the coupling section.

7. The switch apparatus for a vehicle according to claim 1, wherein the coupling section has a sliding hole formed at an inner side thereof in which an operating rod is provided to vertically slide with an elastic force produced by an elastic body, such that an upper portion thereof is disposed inside the switch body.

8. The switch apparatus for a vehicle according to claim 7, wherein the operating rod includes a rod-type member having a central flange part on a circumference thereof and extending in a vertical direction, and an elastic body surrounding an outer side of the rod-type member.

9. The switch apparatus for a vehicle according to claim 8, wherein the sliding hole of the coupling section has a coupling part with a decreasing end, with which the flange part of the operating rod engages to prevent the operating rod from straying downwards therefrom.

10. The switch apparatus for a vehicle according to claim 7, wherein the coupling section has an upper protrusion extending towards the internal space of the switch body and having a bushing through which the operating rod passes.

11. The switch apparatus for a vehicle according to claim 10, wherein the elastic body is supported by the bushing and the flange at upper and lower portions thereof, respectively, to maintain its position.

12. The switch apparatus for a vehicle according to claim 7, wherein the operating rod has a hook part on an upper end thereof disposed in the switch body, and a disc-type coupler fixedly fitted around the hook part so that the switch apparatus is activated as the coupler changes its position with a motion of the operating rod.

13. The switch apparatus for a vehicle according to claim 12, wherein an inner coupler part is provided between the hook part and the coupler to pass through and engage with the hook part, and has an outer engaging step portion around which the coupler is fitted.

14. The switch apparatus for a vehicle according to claim 7, wherein the operating rod has a lower extension passing through the coupling section and coming into contact with a pedal in a vehicle.

15. The switch apparatus for a vehicle according to claim 1, wherein the relay board has a fixing groove into which the clamping bar of the ground member is fixed to support the relay board.

16. The switch apparatus for a vehicle according to claim 1, wherein the coupling section passes through and engages with a bracket hole formed at a central portion of a fixing bracket provided in a vehicle, and a locking bracket part is inserted into the bracket hole to connect the fixing bracket and the coupling section.

17. A switch apparatus for a vehicle comprising:

a switch body connected to a connector of an electronic unit and including a relay board;

a conductive coupling section provided at a lower end of the switch body for coupling to a vehicle body; and a conductive ground member having a base provided at a lower portion of the switch body in an internal space of the switch body for coupling to an upper end of the coupling section, and a clamping bar extending upwards from one side of the base to be coupled to a ground terminal provided at a lower end of the relay board, wherein the coupling section has a sliding hole formed at an inner side thereof in which an operating rod is provided to vertically slide with an elastic force produced by an elastic body, such that an upper portion thereof is disposed inside the switch body, wherein the operating rod includes a rod-type member having a central flange part on a circumference thereof and extending in a vertical direction, and an elastic body surrounding an outer side of the rod-type member, and wherein the sliding hole of the coupling section has a coupling part with a decreasing end, with which the flange part of the operating rod engages to prevent the operating rod from straying downwards therefrom.

18. A switch apparatus for a vehicle comprising:

a switch body connected to a connector of an electronic unit and including a relay board;

a conductive coupling section provided at a lower end of the switch body for coupling to a vehicle body; and a conductive ground member having a base provided at a lower portion of the switch body in an internal space of the switch body for coupling to an upper end of the coupling section, and a clamping bar extending upwards from one side of the base to be coupled to a ground terminal provided at a lower end of the relay board, wherein the relay board has a fixing groove into which the clamping bar of the ground member is fixed to support the relay board.

* * * * *